US011650027B2

(12) United States Patent
Merletti et al.

(10) Patent No.: US 11,650,027 B2
(45) Date of Patent: May 16, 2023

(54) STRUCTURE FOR BALLISTIC PROTECTION OF VEHICLES IN GENERAL AND METHOD FOR THE PRODUCTION THEREOF

(71) Applicant: SAATI S.P.A., Appiano Gentile (IT)

(72) Inventors: Franco Merletti, Appiano Gentile (IT); Thomas Della Vedova, Appiano Gentile (IT); Paolo Canonico, Appiano Gentile (IT)

(73) Assignee: SAATI S.P.A., Appiano Gentile (IT)

( * ) Notice: Subject to any disclaimer, the term of this patent is extended or adjusted under 35 U.S.C. 154(b) by 959 days.

(21) Appl. No.: 16/482,237

(22) PCT Filed: Jan. 23, 2018

(86) PCT No.: PCT/IB2018/050390
§ 371 (c)(1),
(2) Date: Jul. 30, 2019

(87) PCT Pub. No.: WO2018/138625
PCT Pub. Date: Aug. 2, 2018

(65) Prior Publication Data

US 2022/0412698 A1 Dec. 29, 2022

(30) Foreign Application Priority Data

Jan. 30, 2017 (IT) ..... 102017000009754

(51) Int. Cl.
*F41H 5/04* (2006.01)

(52) U.S. Cl.
CPC ..... *F41H 5/0478* (2013.01)

(58) Field of Classification Search
CPC ..... F41H 5/0478
(Continued)

(56) References Cited

U.S. PATENT DOCUMENTS

2011/0203450 A1 8/2011 Carbajal
2017/0191803 A1 7/2017 Price
2019/0017787 A1* 1/2019 Arlen ..... B32B 13/12

FOREIGN PATENT DOCUMENTS

DE 2927653 A1 1/1981
FR 3068287 A1 * 1/2019
(Continued)

OTHER PUBLICATIONS

"SAATIProtection—performance fabrics & hybrid technologies"; all pages (Year: 2022).*

(Continued)

*Primary Examiner* — Samir Abdosh
(74) *Attorney, Agent, or Firm* — Hedman & Costigan, P.C.; James V. Costigan; Kathleen A. Costigan

(57) ABSTRACT

Structure for the ballistic protection of vehicles in general, characterized in that it comprises at least a first textile element and at least an additional element formed of a thermoplastic or thermosetting matrix. The structure forms a ballistic system for light armor plating obtained from at least one textile element and one or more thermoplastic or thermosetting base elements. The first textile element includes textile fibers. The second element can include thermoplastic matrices, thermosetting matrices, matrices based on rubber, elastomeric polymers and thermoplastic films of various kinds, the purpose of which consists in providing mechanical properties such that the use of the element can be extended to the field of armor plating while maintaining a high degree of flexibility. The aforesaid elements together contribute to define an efficient ballistic solution while maintaining a relatively low areal density.

7 Claims, 2 Drawing Sheets

(58) Field of Classification Search
USPC ..... 89/36.02
See application file for complete search history.

(56) References Cited

FOREIGN PATENT DOCUMENTS

| | | | |
|---|---|---|---|
| WO | 2010/036406 | A2 | 4/2010 |
| WO | WO-2022189963 | A1 * | 9/2022 |

OTHER PUBLICATIONS

International Search Report for PCT/IB2018/050390 dated Mar. 26, 2018.
Written Opinion of the International Searching Authority dated Mar. 26, 2018.
English Abstract for DE 2927653 A1 dated Jan. 29, 1981.

* cited by examiner

STRUCTURE FOR BALLISTIC PROTECTION OF VEHICLES IN GENERAL AND METHOD FOR THE PRODUCTION THEREOF

BACKGROUND OF THE INVENTION

The present invention relates to a structure for the ballistic protection (hard armoring) of vehicles in general and a method for the production of said structure.

The field of armor plating is characterized by the use of a wide variety of ballistic materials, often used in combination with one another, such as ballistic steel, ceramics, aramid and/or polyethylene fabrics; these solutions, which can be defined as "hybrid", in particular concern classes of armor plating that comprise armor-piercing shells, with reference to the standard EN 1522-1523, from class FB5 upwards.

A common characteristic of the solutions currently used to satisfy the various protection classes is rigidity, which on one hand facilitates fixing to the interior of the bodywork of a vehicle, while on the other hand requires much more time-consuming installation in terms of manpower.

The possibility of using flexible materials as internal protection of vehicles is of considerable interest to manufacturers, as it greatly simplifies the procedures to integrate the ballistic material in the final structure, which to date requires costly and lengthy manpower in terms of cutting, welding and finishing of the structural parts.

Moreover, if on the one hand the use of rigid systems commonly provides uniformity of response to the impact of a bullet in all points of its surface, on the other hand it requires the use of solutions that weigh considerably more than flexible solutions to cover the same surface area.

Alongside the most evident problems related to the use of a similar system, such as the need of a more powerful engine, more efficient suspensions, and high fuel consumption, the most stressed structural points require heavy maintenance over time, resulting in a decrease in the useful life of the vehicle.

Often, armor plating of a vehicle requires the simultaneous use of more than one type of material, as a function of the area involved by the protection.

By way of example, ballistic steel is almost always used for large and flat parts, such as the roof and central door panels, while fiberglass or UHMWPE is used for the wheel arches and curved parts.

It is evident how the use of a light and flexible material would allow any surface, even complex, to be addressed without any installation difficulties.

Currently, numerous materials and solutions are available that comply with the needs of installers to provide the vehicle user with adequate protection.

The characteristics of these protections depend directly on the threat to be addressed.

In the field of light armor plating, according to class FB4 and lower of the standard EN 1522-1523, the most commonly used materials are:

Multi-layer UHMWPE (Ultra High Molecular Weight Polyethylene) available in semi-rigid panels having a thickness of less than 10 mm and approximate areal density of 6 kg/m$^2$;

ballistic steel, with Brinell hardness of at least 450, in the form of sheets having a thickness less than or equal to 4 mm and areal density of less than 20 kg/m$^2$;

fiberglass panels, pre-shaped or in sheets, with areal density no greater than 15 kg/m$^2$ and thickness from 10 to 15 mm;

aramid fiber panels, pre-shaped or in sheets.

SUMMARY OF THE INVENTION

The aim of the present invention is to provide a new structure for the ballistic protection of vehicles in general, improved in comparison with currently known structures.

Within this aim, an object of the invention is to provide a structure that constitutes an effective ballistic solution while maintaining a relatively low areal density.

Another object of the invention is to provide a structure formed of a fabric suitably modified in its flexibility in such a manner as to allow its use in the field of armor plating without requiring to relinquish either its flexibility or its effectiveness in addressing the specific threat.

A further object of the present invention is to provide a flexible structure that allows a reduction in weight and an increase in versatility, together with optimization of the manpower required to armor plate vehicles, with specific to reference to surfaces with more complex shapes.

This and other objects, which will be more apparent below, are achieved by a structure for the ballistic protection of vehicles in general characterized by comprising at least a first textile element and at least an additional element formed of a thermoplastic or thermosetting matrix.

BRIEF DESCRIPTION OF THE DRAWINGS

Further characteristics and advantages of the present invention will be more apparent from an examination of the description of a preferred but non-exclusive embodiment of the invention, illustrated by way of non-limiting example in the accompanying perspective drawing sheet, wherein.

DESCRIPTION OF PREFERRED EMBODIMENTS

Figure 1:
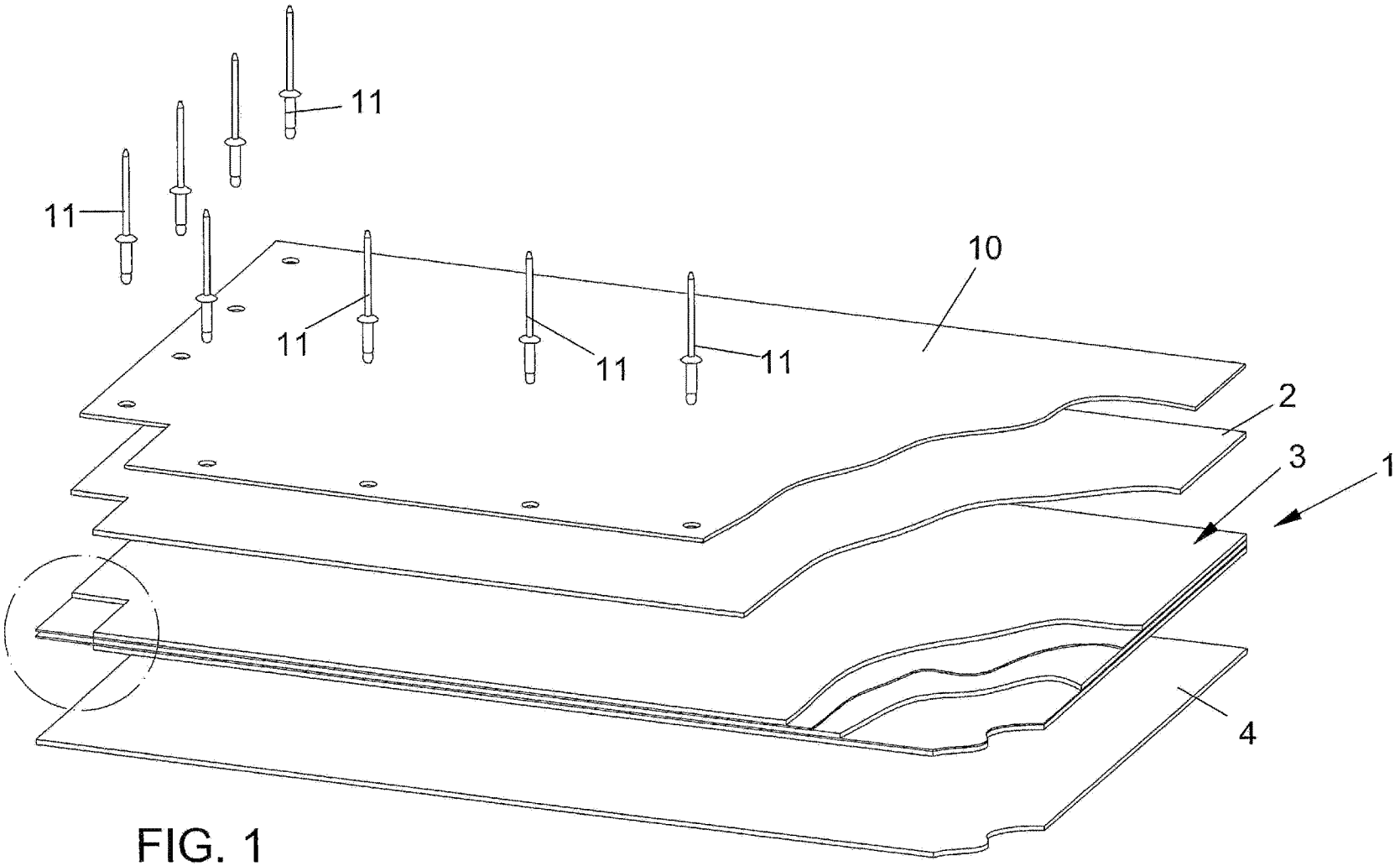
FIG. 1 is an exploded perspective view of the structure according to the present invention, illustrated with elements for fixing to a support consisting of the bodywork of a vehicle.
Figure 2:
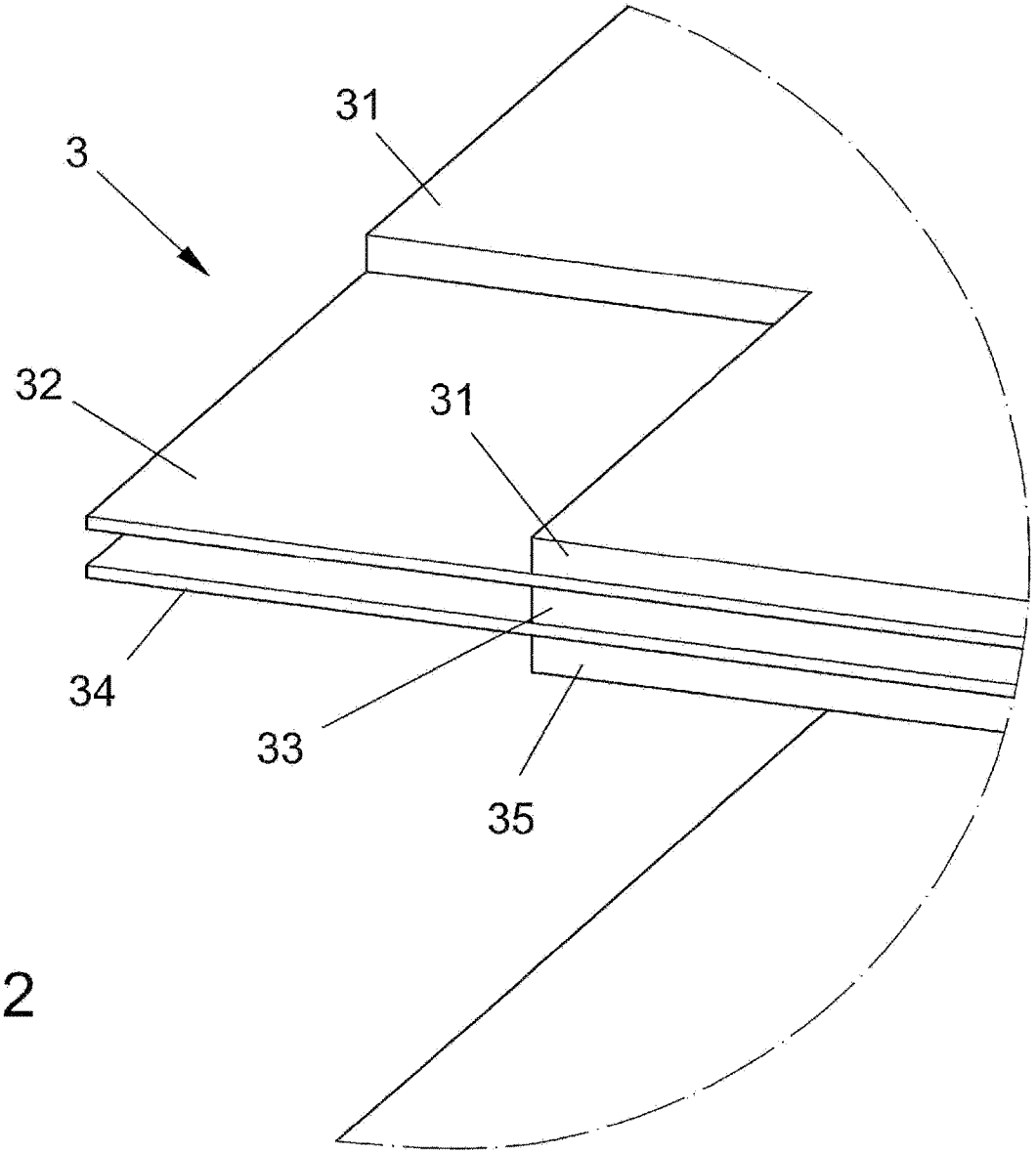
FIG. 2 is an enlarged perspective view illustrating in detail the components of the additional element of the structure.

With particular reference to the numerical symbols of the aforesaid figures, the structure for ballistic protection according to the invention, indicated as a whole with the reference numeral 1, comprises a first textile element 2 and an optional second textile element 4, and at least an additional element 3.

The textile elements 2 and 4 are advantageously formed of textile panels made of woven ballistic layers reinforced with fibers mechanically entangled in the interstices of the woven layers to form a consolidated material known with the trade name CoreMatrix (US 2017/0191803 A1), manufactured by the same Applicant.

The additional element 3 is formed of a series of layers, identified with the reference numerals 31, 33 and 35, formed by CoreMatrix textile elements, with layers of matrix 32 and 34 interposed.

The additional element 3 can include thermoplastic matrices, thermosetting matrices, matrices based on rubber, elastomeric polymers and thermoplastic films of various kinds, the purpose of which consists in providing mechanical properties such that the use of textile elements 2 and 4 can be expanded to the field of armor plating while maintaining a high degree of flexibility.

As illustrated schematically in FIG. 1, the structure 1 of the present invention can be applied to a support, consisting of the bodywork of a vehicle, indicated with the reference numeral 10, by means of riveting 11.

The elements described above together contribute to define an efficient ballistic solution while maintaining a relatively low areal density.

The structure is produced by means of a coating, lamination and/or pressing process of conventional fabrics and/or fabrics in the range known with the trade name "Corematrix", of the type used for the production of bullet-proof vests, with a thermoplastic or thermosetting matrix.

The use of a prevalent percentage of fabric with respect to the matrix makes it possible to formulate solutions that maintain the flexibility of the base fabric and therefore the specific flexibility that distinguishes the product from the range of common armor platings.

The base fabrics can be para-aramid matrix fabrics (Kevlar®, Twaron®, or similar fabrics available on the market), or polyethylene matrix fabrics such as UHMWPE (Spectra®, Dyneema®, Tensylon® or similar fabrics available on the market) or other fabrics formed of high tenacity fibers.

There are no limits to the areal densities of the fabrics that can be used.

Impregnation/lamination allows compacting of one or more layers of the structure formed of the first textile element and of the additional element by means of pressing.

However, ballistic data show that the flexibility of a structure obtained in this way is also useful for a more effective operation of the product.

The presence of a matrix in too high a percentage would stiffen the structure of the fabric to the extent that it would become fragile, thus reducing the capacity to absorb impact energy.

The production method of the structure according to the present invention provides for stabilization consisting of partial melting of the thermoplastic matrix by means of calendering or hot lamination, or the use of IR lamps, whose process parameters vary according to the thermoplastic material used.

The resulting structure can undergo compaction of one or more of its layers, by means of pressing.

The structure can be applied to the supporting part of the vehicle by means of riveting and/or gluing, allowing optimization of the final weight, installation times and methods.

The additional element can comprise thermoplastic matrices, thermosetting matrices, matrices based on rubber or elastomeric polymers, or combinations thereof, or laminated with thermoplastic films of various kinds, such as PE, PU, PP, PA, EVA, or in principle any thermoplastic material suitable for possible extrusion into film.

The structure of the present invention is efficient in stopping bullets and, due to its flexibility, it is capable of satisfying the standards of protection of vehicles.

The structure of the present invention can be combined in different ways with structures already existing on the market, thus imparting different energy absorption properties.

The following example represents experimental tests conducted by the Applicant and is provided purely for non-limiting illustrative purposes.

In the light of the methods with which the ballistic test is conducted, which do not provide for any standard fastening method with regard to the flexible materials, the ballistic part was integrated in a semi-definitive prototype.

Each test sample 50×50 cm in size was produced in the same way in which it would be applied to the vehicle.

The structure was glued and riveted to a 0.8 mm sheet of non-ballistic steel, so as to make it integral with a rigid support and to ensure adequate fixing to the target of the shooting system by means of clamps.

The structure presented here was also certified in accordance with the protection class FB4, standard EN 1523, at the Spanish laboratory AITEX with registered office in Alicante.

The following ballistic data refer to a solution with areal density of 6.3 kg/m$^2$, formed of (in order):

a layer of Corematrix FF9354, three layers of Corematrix FF9354 laminated with two layers of thermoplastic film, a layer of Corematrix FF9354, all held together by a perimeter seam at 3 cm from the outer edge.

| Panel | Shot number | Velocity (m/s) | Result* |
|---|---|---|---|
| Cal 357 mm Magnum FJ/–430 ± 10 m/s | | | |
| 1 | 1 | 422.7 | P |
| | 2 | 426.9 | P |
| | 3 | 425.4 | P |
| 2 | 4 | 426.6 | P |
| | 5 | 428.1 | P |
| | 6 | 426.4 | P |
| 3 | 7 | 425.8 | P |
| | 8 | 425.7 | P |
| | 9 | 426.8 | P |
| Cal. 44 Mag JHC –440 ± 10 m/s | | | |
| 1 | 1 | 432.8 | P |
| | 2 | 437.0 | P |
| | 3 | 434.6 | P |
| 2 | 4 | 438.3 | P |
| | 5 | 433.9 | P |
| | 6 | 432.8 | P |
| 3 | 7 | 435.8 | P |
| | 8 | 435.5 | P |
| | 9 | 436.8 | P |

*P = partial penetration;
C = complete penetration;

In practice, it has been found that the invention achieves the intended aim and objects.

In fact, a composite structure has been provided that forms a ballistic system for light armoring obtained from articles formed of a multi-layer structure composed of woven and nonwoven fabric, of the type already used for bullet-proof vests, so processed as to adapt this type of fabrics to the use in the field of armor plating, by using a method that does not alter the ballistic properties and a processing that preserves its flexibility.

The structure of the present invention is based on the idea of modulating the flexibility of a fabric such as CoreMatrix® in such a manner as to allow its use in the field of armor plating, without relinquishing either its flexibility or its effectiveness in addressing the specific threat.

Naturally, the materials used, and the dimensions, can be any according to requirements.

The invention claimed is:

1. A structure for ballistic protection of vehicles in general comprising a first textile element (2), at least a second textile element (4) and at least an additional element (3) interposed between said first textile element and said second textile element, characterized in that said at least an additional element (3) is formed of layers (31,33,35) with layers of matrix (32,34) interposed, said additional element (3) being interposed between said textile elements, said layers (31,33, 35) and said first textile element and said second textile element being textile panels made of woven ballistic layers reinforced with fibers mechanically entangled in the interstices of the woven layers to form a consolidated material.

2. A structure according to claim 1, characterized in that said first textile element further comprises one or more yarns among para-aramid matrix yarns.

3. A structure according to claim 1, characterized in that said additional element (3) comprises one or more matrices (32,34) among thermoplastic matrices, thermosetting matrices, matrices based on rubber or elastomeric polymers, or a combination thereof, or laminated with thermoplastic films of various kinds, such as PE, PU, PP, PA, EVA, or any thermoplastic material suitable to be extruded into film.

4. A structure according to claim 1, characterized in that it comprises a layer (31) of woven ballistic layers reinforced with fibers mechanically entangled in the interstices of the woven layers to form a consolidated material, three layers (33) of of woven ballistic layers reinforced with fibers mechanically entangled in the interstices of the woven layers to form a consolidated material laminated with two layers (32,34) of thermoplastic film; a layer (35) of of woven ballistic layers reinforced with fibers mechanically entangled in the interstices of the woven layers to form a consolidated material.

5. A structure according to claim 4, characterized in that said layers are held together by a perimeter seam.

6. A method for the production of a structure for ballistic protection of vehicles in general according to claim 1, characterized in that said method comprises a partial melting of a thermoplastic or thermosetting matrix on a textile element made of woven ballistic layers reinforced with fibers mechanically entangled in the interstices of the woven layers to form a consolidated material by means of calendering or hot lamination, or the use of IR lamps.

7. A method according to claim 6, characterized in that it comprises a step of compacting one or more layers of said matrix and said textile element, by means of pressing.

* * * * *